United States Patent [19]

Silverman

[11] Patent Number: 4,724,623

[45] Date of Patent: Feb. 16, 1988

[54] FOOTWEAR FOR INFANTS AND TODDLERS

[75] Inventor: Jeffrey Silverman, Cos Cob, Conn.

[73] Assignee: Toddler U, Inc., White Plains, N.Y.

[21] Appl. No.: 760,934

[22] Filed: Jul. 31, 1985

[51] Int. Cl.[4] ..... A43B 03/30; A43B 03/28; A43B 23/26

[52] U.S. Cl. ..... 36/112; 36/54

[58] Field of Search ..... 36/112, 111, 136, 11, 36/90, 97, 102, 43, 54

[56] References Cited

U.S. PATENT DOCUMENTS

| | | | |
|---|---|---|---|
| 1,365,072 | 1/1921 | Abramowitz | 36/11 |
| 1,438,072 | 12/1922 | Wagner | 36/11 |
| 2,004,897 | 6/1935 | Lussier | 36/54 |
| 2,212,516 | 8/1940 | Engel | 36/54 |
| 2,215,924 | 9/1940 | Grundman | 36/54 |
| 2,327,415 | 8/1943 | Korschner | 36/11 |
| 2,630,636 | 3/1953 | Cockrell | 36/11 |
| 2,654,965 | 10/1953 | Sloan et al. | 36/54 |
| 3,058,241 | 10/1962 | Rigsby | 36/112 |
| 3,110,117 | 11/1963 | Ruebel | 36/112 |
| 3,139,179 | 5/1964 | Laham | 36/112 |
| 3,142,911 | 8/1964 | Waters | 36/112 |
| 3,350,795 | 11/1967 | Schlecht | 36/11 |
| 3,463,163 | 8/1969 | Mathes | 36/112 |
| 3,618,235 | 11/1971 | Cary | 36/97 |
| 3,681,860 | 8/1972 | Bidegain | 36/112 |
| 3,744,163 | 7/1973 | Simister | 36/112 |
| 3,949,494 | 4/1976 | Giannoni | 36/90 |
| 4,202,117 | 5/1980 | Bidegain | 36/112 |
| 4,296,558 | 10/1981 | Antonious | 36/102 |
| 4,370,818 | 2/1983 | Simoglou | 36/54 |
| 4,372,057 | 2/1983 | Nielsen | 36/43 |
| 4,599,811 | 1/1986 | Rousseau | 36/97 |

FOREIGN PATENT DOCUMENTS

| | | | |
|---|---|---|---|
| 1099569 | 2/1954 | France | 36/90 |
| 3101762 | 7/1982 | German Democratic Rep. | 36/112 |

*Primary Examiner*—Steven N. Meyers

*Attorney, Agent, or Firm*—Steinberg & Raskin

[57] ABSTRACT

Footwear for infants and toddlers which allow the child's foot to relax in a natural, "barefoot" condition, i.e., without exerting substantial pressure on the toes and sides of the foot, and which facilitate the fitting of the shoe onto the foot. The shoe comprises a sole and an upper fastened to the sole for surrounding the sides and heel of the foot. The upper includes a pair of flexible side regions having a respective pair of edge regions which extend rearwardly substantially from a forward end of the toe portion of the sole in mutually spaced relationship for overlying the toe and instep regions of the foot. A tongue is fastened to the upper at its forward end and only to a side region of the upper which itself is fastened to the forward end of the toe portion of the sole so that the side edges of the tongue are unconnected to any part of the upper. The tongue extends rearwardly for covering both the toe and instep regions of the foot.

12 Claims, 8 Drawing Figures

FIG. 1A
PRIOR ART
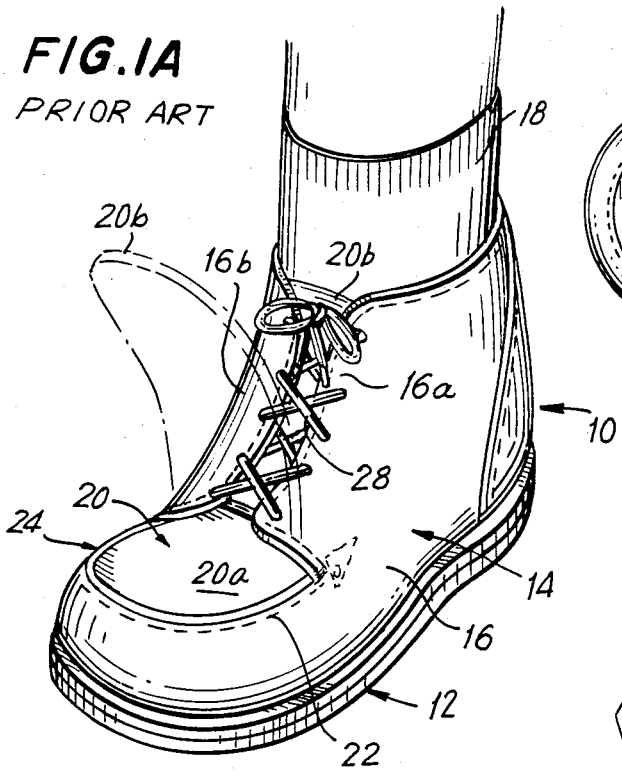
FIG. 1B
PRIOR ART
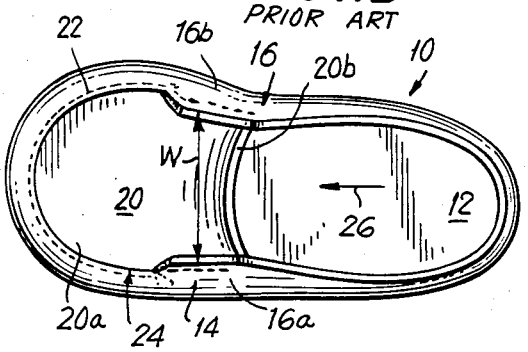
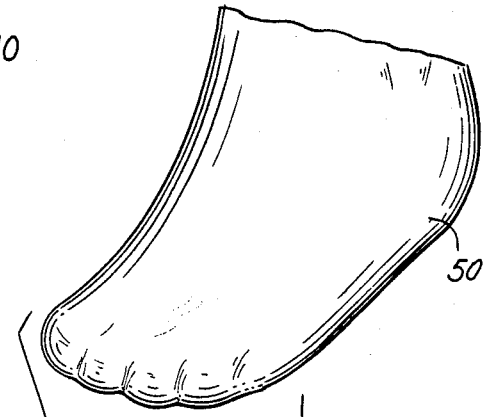
FIG. 2
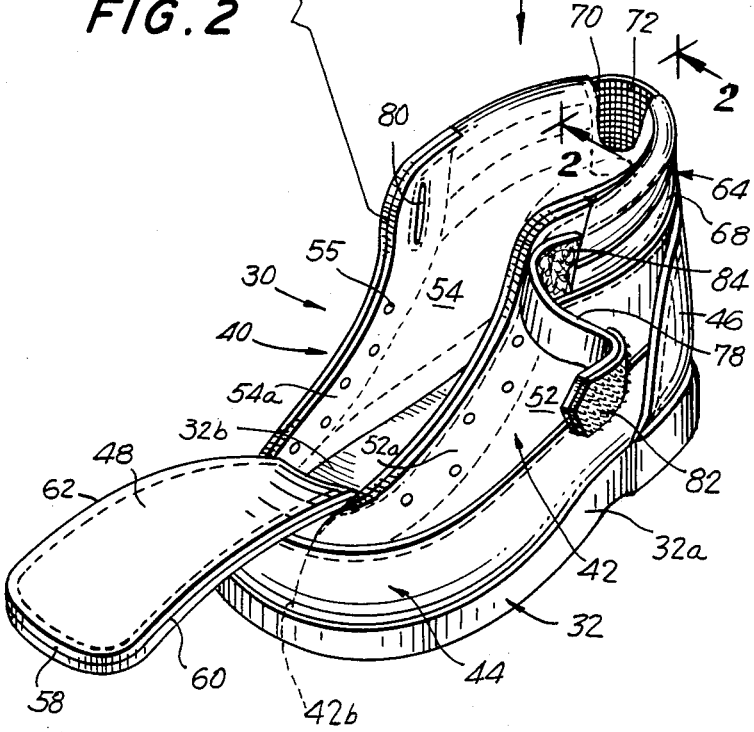
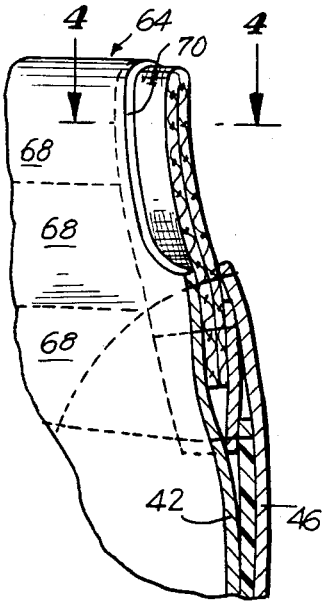
FIG. 3

FOOTWEAR FOR INFANTS AND TODDLERS

BACKGROUND OF THE INVENTION

This invention relates to footwear designed specifically for infants and toddlers.

It has been recognized that the most important consideration in connection with shoes for infants and toddlers, i.e., children ranging in age from about three months to about forty-eight months, is fit. A properly fitting shoe will not only permit a child's rapidly growing foot to develop normally, but will also allow the various orthopedic conditions with which it has been estimated between 50 and 90 percent of children are born to resolve themselves.

Properly fitting infant and toddler shoes will exert little or no pressure on the sides of the feet and have sufficient toe room that, when the child stands, the foot can assume the same position as if the child were barefoot. In other words, infant and toddler shoes should be big enough to let the toes spread without cramping. The shoes also should be flexible and well ventilated.

Conventional shoes which have been specifically designed for infants and toddlers are not entirely satisfactory. In particular, typical conventional infant and toddler shoes are constructed having a sole and an upper which form a rigid, inflexible toe box or toe cap in which the child's toes are received. The width of the toe box is fixed and invariable. Accordingly, even if the shoe is properly fitted when initially purchased, the conventional shoe will by its very design cause pressure to be exerted on the foot. Furthermore, the growth of a child's foot at this age is so rapid that the toes become cramped within the toe box and the pressure exerted on the sides of the foot increases after only a relatively short time.

The construction of conventional shoes for infants and toddlers makes it extremely difficult to achieve a proper fit in the first instance. Most toddlers have relatively wide feet and it has been estimated that 80 percent of all toddlers have an "E" or greater width. Moreover, toddlers tend to reflexively curl their toes during a shoe-fitting procedure. Since the toe box is of a rigid, inflexible construction, it is difficult to insert the wide child's foot into a conventional shoe, regardless of whether the shoe is of the correct size or not. This usually results in the shoe being incorrectly fitted.

SUMMARY OF THE INVENTION

Accordingly, it is an object of the present invention to provide new and improved footwear for infants and toddlers.

Another object of the present invention is to provide new and improved infant and toddler footwear which fits properly.

Still another object of the present invention is to provide new and improved infant and toddler footwear which exerts substantially no pressure on the sides of the foot and which provides sufficient toe room to allow the toes to spread without cramping.

A further object of the present invention is to provide new and improved infant and toddler footwear which is adjustable to provide a proper fit over reasonable periods of growth of the foot.

A still further object of the present invention is to provide new and improved infant and toddler footwear which is flexible and well ventilated.

Briefly, in accordance with the present invention, these and other objects are attained by providing infant and toddler footwear comprising a shoe having a sole and an upper fastened thereto for surrounding the sides and heel of the foot. The upper includes a pair of flexible side regions having a respective pair of elongated edge regions which extend rearwardly substantially from a forward end of the toe portion of the sole in mutually spaced relationship for overlying both the toe and the instep regions of the foot. A relatively long tongue is fastened to the upper only at its forward end and only to the region of the upper which itself is fastened to the forward end of the toe portion of the sole. The tongue extends rearwardly for covering the both the toe and instep regions of the foot.

Substantially the entire length of the tongue can be pulled from the shoe during the fitting procedure to cause the flexible side regions of the upper to spread apart by the interengagement of the side edges of the tongue and the spaced edge regions of the upper to provide free and open access to substantially the entire interior of the shoe to facilitate the fitting procedure. Unlike conventional toddler shoe construction where the toes must be inserted forwardly into a rigid and confined toe box through a narrow fixed space prior to the rest of the foot being fitted into the shoe, the construction of the invention allows substantially the entire foot to be inserted into the shoe in a one-step procedure in a downward direction and with the flexible side regions of the upper facilitating insertion of the foot.

After the foot is inserted into the shoe, the tongue is returned to cover both the toe and instep regions of the foot whereupon the side edges of the flexible side regions of the upper are flexed to overlie the tongue to conform to the shape of the toe and instep regions of the foot and fastened to each other, such as by laces. In this manner, a sort of toe box is created whose shape is actually determined by the shape of the foot. As the toe box is substantially flexible and conforms to the shape of the child's foot, it will exert substantially no pressure on the side of the foot and can be adjusted to accommodate growth of the foot for a reasonable period. The construction provides the shoe with greater flexibility than in the case of conventional infant and toddler shoe construction whose flexibility is limited by the rigid toe box.

DETAILED DESCRIPTION OF THE DRAWINGS

A more complete appreciation of the present invention and many of the attendant advantages thereof will be readily understood by reference to the following detailed description when considered in connection with the accompanying drawings in which:

FIG. 1A is a perspective view of a conventional prior art toddler shoe fitted on a child's foot;

FIG. 1B is a top plan view of the prior art shoe shown in FIG. 1A with its tongue in an upper position as shown in phantom in FIG. 1A in condition for fitting to a child's foot;

FIG. 2 is a perspective view of a toddler shoe in accordance with the present invention in condition for fitting to a child's foot, also shown;

FIG. 3 is a section view along line 3—3 of FIG. 2;

Figure 4:
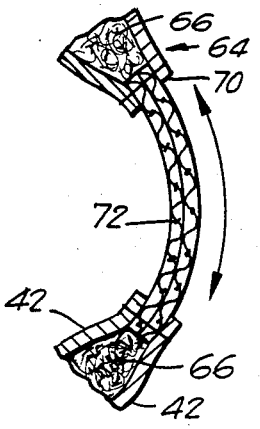
FIG. 4 is a section view taken along line 4—4 of FIG. 3.
Figure 5:
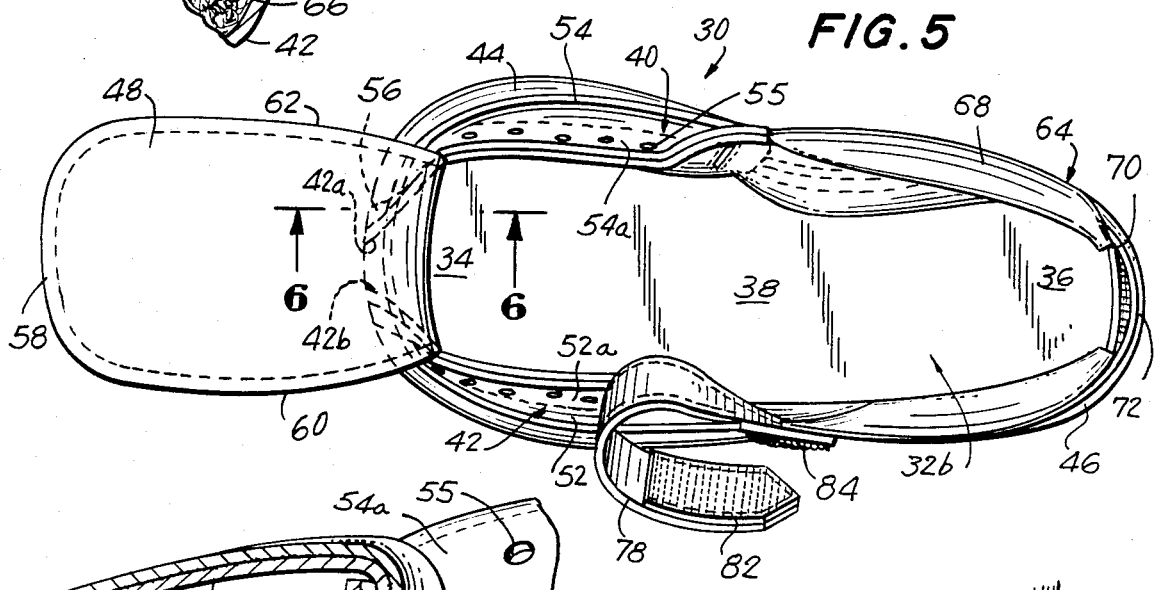
Figure 6:
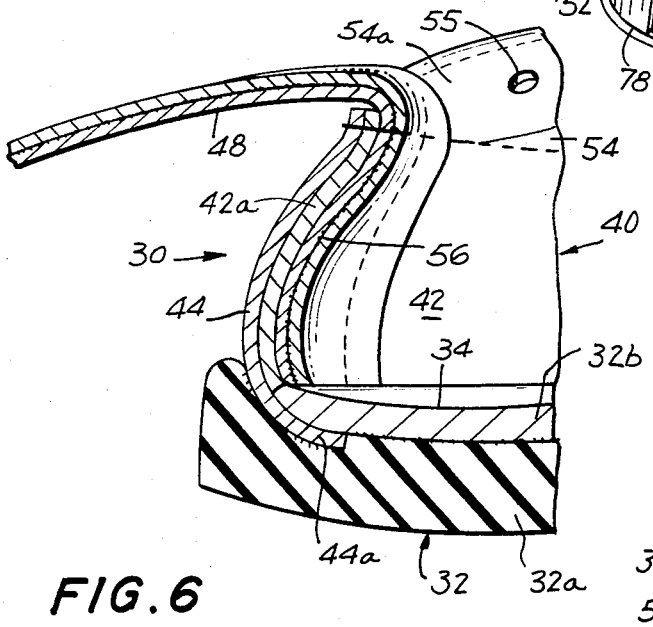

FIG. 5. is a top plan view of the toddler shoe shown in FIG. 2 in condition for fitting to a child's foot;

FIG. 6 is a section view taken along line 6—6 of FIG. 5; and

Figure 7:
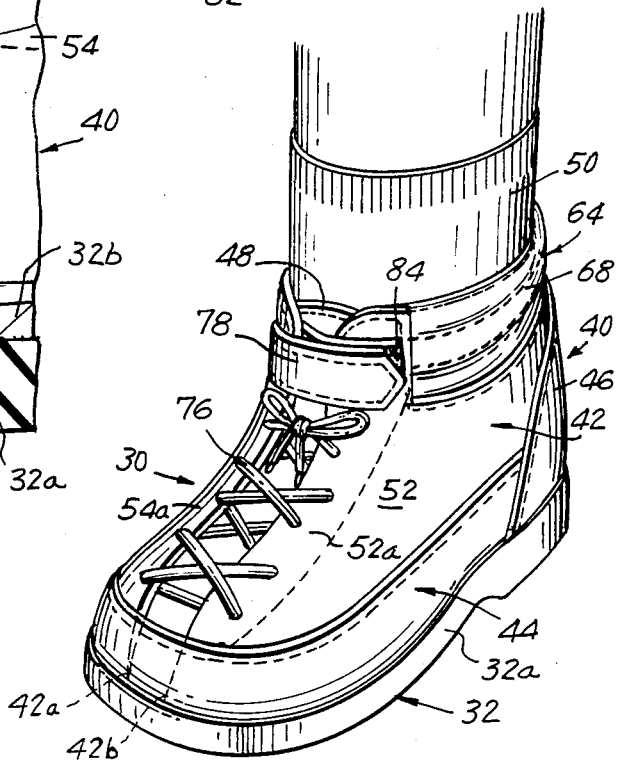

FIG. 7 is a perspective view of a toddler shoe shown in FIG. 2 fitted on a child—s foot.

DESCRIPTION OF THE PREFERRED EMBODIMENT

Referring now to the drawings wherein like reference characters designated identical or corresponding parts throughout the several views, a conventional prior art toddler's shoe, generally designated 10, is shown in FIGS. 1A and 1B. The shoe comprises a heavy sole 12 and a lighter upper 14 formed of leather or the like attached to sole 12. The upper 14 includes a vamp 16 for surrounding the sides and heel of the child's foot 18 and a leather piece 20 having a forward portion **20*a* and a rearward portion 20*b*, the latter constituting the tongue of the shoe. The entire circumference of forward portion 20*a* of piece 20 is stitched to vamp 16 along seam 22 to form a toe box 24. The vamp 16 includes a pair of side regions 6*a* and 16*b* extending from the rearward ends of seam 22 for overlying only the instep region of the foot 18**.

In fitting the child's foot into shoe 10, the tongue **20*b* is initially pulled upwardly and outwardly as shown in phantom in FIG. 1A to the position illustrated in FIG. 1B. It is noted that the toe box 24 defined by the forward portion 20*a* of piece 20 and the surrounding part of vamp 16 remains rigid and intact with a fixed, relatively narrow width W. The toes of the child's foot are then inserted forwardly into the toe box 24 in the direction of arrow 26 through the narrow, fixed dimension entry space of width W into the toe box 24 whereupon the rest of the foot is inserted downwardly into the shoe 12. The tongue 20*b* is then positioned over the instep of the foot whereupon the side regions 16*a* and 16*b* of vamp 16 are positioned to overlie tongue 20*b* as seen in FIG. 1A. The vamp side regions are then laced together by laces 28**.

As noted above, an undesireable pressure will be exerted on the foot due to the rigid and inflexible construction of toe box 24 having a fixed width. Even if initially properly fitted, the child's toes will become cramped within the toe box after a short time due to the rapid growth of the child's foot. The construction of the toe box also makes the fitting procedure difficult, especially where the child tends to curl his toes during insertion into the toe box.

Referring now to FIGS. 2–7 and, in particular to FIGS. 2, 5 and 7, a shoe constructed in accordance with the present invention, generally designated 30, comprises a sole 32 having a forward toe portion 34, a rearward heel portion 36 and an intermediate portion 38 between the toe and heel portions, and an upper 40 formed of lighter material, such as leather, fastened to a portion of the sole extending around its periphery, such as by a suitable adhesive. Sole 32 includes an outersole **32*a* and a preferably removable innersole 32*b*. Upper 40 includes a vamp 42, foxing 44, a heel counter 46 and a tongue 48. Vamp 42 extends around substantially the entire periphery of the shoe 30 for embracing the sides and heel of the foot 50 and terminates at a pair of spaced ends 42*a* and 42*b* (FIG. 5) at the front of the shoe, i.e., at the front of the forward end of the toe portion 34 of sole 32 spaced inwardly from the lateral sides of the shoe as clearly seen in FIG. 5. Vamp 42 has a pair of flexible side regions 52 and 54 having a respective pair of elongated edge regions 52*a* and 54*a* respectively which extend substantially longitudinally rearwardly in mutually spaced relationship substantially parallely from the spaced vamp ends 42*a* and 42*b* at the front of the forward end of the toe portion 34 of sole 32 spaced inwardly from the lateral sides of the shoe for overlying both the toe and instep regions of the foot. Longitudinal rows of openings 55 are formed in edge region 52*a* and 54*a*** for laces.

Foxing 44 is seamed to and extends around the lower side and front regions of vamp 42 and includes a downwardly depending edge portion **44*a* which projects below vamp 42 and which is folded inwardly for connection to the sole 32 as seen in FIG. 6. The heel counter 46 is also seamed to the vamp 42 and extends around the heel region. Like foxing 44, the heel counter 46 includes a downwardly depending edge portion which projects below vamp 42 and which is folded inwardly for connection to the sole 32**.

Tongue 48 comprises a relatively long piece of material for covering both the toe and instep regions of the foot. Tongue 48 has a forward end 56, a rearward end 58 and longitudinal side edges 60 and 62 extending between them. The forward end 56 of tongue 48 spans the space between and overlaps the interior sides of the ends **42*a* and 42*b* of vamp 42 as seen in FIG. 5 and is fastened to upper 10 at those ends 42*a* and 42*b* of vamp 42 at the front of the forward end of the toe portion 34 of sole 32 and to the small region of foxing 44 extending therebetween as seen in FIG. 6. The longitudinal side edges 60 and 62 of tongue 48** are not attached to any part of the upper.

The top of the vamp 42 is formed in the shape of a collar 64. Vamp 42 is preferably formed of two-ply material and a spongy filler 66 may be provided between the plies at collar 64 to form ribs 68 after appropriate seaming. Alternatively, the seaming may be omitted so that the collar 64 is essentially padded for comfort and to prevent slippage of the shoe and the formation of blisters. A notch 70 is formed at the upper rear of collar 64 and a folded-over piece of stretchable elastic material 72 is secured between the plies of vamp 42 to extend across the notch 70 as best seen in FIG. 3. The elastic material allows the collar 64 to stretch in a circumferential direction so that the shoe essentially molds to the particular shape of the child's ankle to prevent rubbing and chafing.

Referring to FIGS. 2 and 5, in fitting the child's foot into shoe 30, the tongue 48 is initially pulled upwardly and outwardly to the position shown in the figures. Substantially the entire length of the tongue can be pulled out of the shoe since the only point of connection of the tongue to the upper 40 is at the forward end of the toe portion of the sole. Pulling the tongue out of the shoe causes the flexible side regions 52 and 54 of vamp 42 to spread apart by the interengagement of the longitudinal side edges 60 and 62 of the tongue 48 and the spaced edge regions **52*a* and 54*a* of vamp 42 to provide free and open access to substantially the entire interior of the shoe as seen in FIG. 5. Thus, unlike the case in conventional toddler shoe construction where the child's toes must first be squeezed into a rigid and confined toe box, the construction of the invention allows the child's foot to be inserted into the shoe with a single gliding motion as designated by arrow 74 in FIG. 2 in a one-step procedure. The flexible side regions 52 and 54 of vamp 42** facilitate insertion of the foot into the shoe.

After the child's foot has been inserted into the shoe, the tongue 48 is returned to cover both the toe and instep regions of the foot, whereupon the side regions 52 and 54 of vamp 42 are flexed over tongue 48 to conform to the shape of the toe and instep region of the foot. The side regions are fastened to each other by means of laces 76 passing through openings 55 in the edge regions 52a and 54a. Additionally, a strap 78 may be provided with one of its ends being attached to one end region of collar 64. A slot 80 is formed in the other end region of collar 64 through which the strap 78 passes and Velcro fasteners 82 and 84 are provided on the strap to allow fastening as shown in FIG. 7.

It is seen from the foregoing that a sort of toe box is formed when the shoe is fitted to the child's foot, the shape of which is actually determined by the shape of the foot itself. As the toe box is substantially flexible and conforms to the shape of the child's foot, it will exert substantially no pressure on the side of the foot. The child's foot can relax in a natural "barefoot" condition with no pinching or cramping. The shoe will automatically conform to the shape of the child's foot over a reasonable growth period. Additionally, by omitting the rigid toe box, a shoe constructed in accordance with the invention will have greater flexibility than conventional toddler's shoes.

Obviously, numerous modifications and variations of the present invention are possible within the light of the above teachings. It is therefore to be understood that within the scope of the claims annexed hereto, the invention may be practiced otherwise than as specifically disclosed herein.

What is claimed is:

1. A shoe for infants and toddlers comprising:

a sole having a forward toe portion, a rearward heel portion, an intermediate portion between said toe and heel portions and a peripheral portion extending around the periphery of said sole;

an upper fastened to said peripheral portion of said sole for surrounding the side and heel regions of a foot and terminating at a pair of closely spaced ends which are situated proximate to each other at a central region of the front of a forward end of said sole toe portion spaced inwardly from respective lateral sides of the shoe, said upper including a pair of flexible side regions having a respective pair of elongated edge regions extending substantially longitudinally rearwardly in mutually spaced substantially parallel relationship substantially from said closely spaced ends of said upper at the front of the forward end of said sole toe portion spaced inwardly from respective lateral sides of the shoe for overlying both the toe and instep regions of the foot; and a tongue having forward and rearward ends and side edges extending longitudinally therebetween, said tongue being fastened to said upper only at the front of said forward toe portion of said sole, said side edges of said tongue being free and unconnected to said upper, said tongue extending rearwardly for covering both the toe and instep regions of the foot.

2. A shoe for infants and toddlers comprising:

a sole having a forward toe portion, a rearward heel portion, an intermediate portion between said toe and heel portions and a peripheral portion extending around the periphery of said sole;

an upper fastened to said peripheral portion of said sole for surrounding the side and heel regions of a foot and terminating at a pair of closely spaced ends situated at the front of a forward end of said sole toe portion spaced inwardly from respective lateral sides of the shoe, said upper including a pair of flexible side regions having a respective pair of elongated edge regions extending substantially longitudinally rearwardly in mutally spaced substantially parallel relationship substantially from said closely spaced ends of said upper at the front of the forward end of said sole toe portion spaced inwardly from respective lateral sides of the shoe for overlying both the toe and instep regions of the foot; and a tongue having forward and rearward ends and side edges extending longitudinally therebetween, said tongue being fastened to said upper only at the front of said forward toe portion of said sole, said forward end of said tongue spanning the space between and overlapping interior sides of said closely spaced ends of said upper, said tongue being fastened to said upper only at said spaced ends of said upper at the front of said sole toe portion, said side edges of said tongue being free and unconnected to said upper, said tongue extending rearwardly for covering both the toe and instep regions of the foot.

3. The combination of claim 2 wherein said upper includes a vamp including said pair of flexible side regions, said vamp extending around substantially the entire periphery of the shoe for embracing the sides and heel of the foot.

4. The combination of claim 2 wherein said upper includes a vamp including said pair of flexible side regions, said vamp having a portion situated at the front of the shoe, and wherein said tongue is fastened to said vamp portion.

5. The combination of claim 4 wherein said vamp extends around substaantially the entire periphery of the shoe for embracing the sides and heel of the foot, said vamp terminating at said pair of closely spaced ends and said tongue is fastened to said vamp ends.

6. The combination of claim 2 wherein said upper includes a vamp including said pair of flexible side regions and foxing fastened to and extending around at least the lower side and front regions of said vamp.

7. The combination of claim 6 wherein said foxing includes a downwardly depending portion which projects below said vamp for connection to said sole.

8. The combination of claim 6 wherein said upper further includes a heel counter fastened to and extending around a heel region of said vamp, said heel counter including a downwardly depending portion which projects below said vamp for connection to said sole.

9. The combination of claim 2 wherein said tongue comprises a long piece of material, said longitudinal side edges of said tongue adapted to interengage said elongated edge regions of said upper when said tongue is pulled out of said shoe whereby said flexible side regions are spaced apart to provide open access to substantially the entire interior of said shoe.

10. The combination of claim 2 wherein said upper has a top portion formed as a padded collar.

11. The combination of claim 10 wherein said collar is formed with ribs.

12. The combination of claim 2, wherein said upper has a notch formed therein at a top portion thereof, and wherein a stretchable elastic material is fastened in said notch.

* * * * *